United States Patent [19]

Scherbarth et al.

[11] Patent Number: 4,658,729

[45] Date of Patent: Apr. 21, 1987

[54] MODULAR FIBER ARMATURE FOR ELECTROMAGNETIC LAUNCHERS

[75] Inventors: David W. Scherbarth, Wilkinsburg; Samuel J. Scuro, Penn Township, Westmoreland County, both of Pa.; Gerald L. Ferrentino, Madison, N.J.

[73] Assignee: Westinghouse Electric Corp., Pittsburgh, Pa.

[21] Appl. No.: 652,405

[22] Filed: Sep. 20, 1984

[51] Int. Cl.[4] ..... F41F 1/02

[52] U.S. Cl. ..... 102/520; 89/8; 124/3

[58] Field of Search ..... 102/520–523, 102/532; 89/8; 124/3; 310/12–14; 376/108; 318/38, 135; 29/1.2, 1.23

[56] References Cited

U.S. PATENT DOCUMENTS

| | | | |
|---|---|---|---|
| 4,430,921 | 2/1984 | Hughes et al. | 89/8 |
| 4,457,205 | 7/1984 | Ross | 89/8 |
| 4,467,696 | 8/1984 | McNab et al. | 310/12 X |
| 4,480,523 | 11/1984 | Young et al. | 89/8 |
| 4,485,720 | 12/1984 | Kemeny | 89/8 |

FOREIGN PATENT DOCUMENTS

| | | | |
|---|---|---|---|
| 2123934 | 2/1984 | United Kingdom | 89/8 |

OTHER PUBLICATIONS

D. W. Deis and I. R. McNab, "A Laboratory Demonstration Electromagnetic Launcher", IEEE Trans on Magnetics, vol. 18, #1, Jan. 82, pp. 16–22.

D. W. Deis and D. P. Ross, "Experimental Launcher Facility–Elf–1: Design and Operation", IEEE Trans on Magnetics, vol. 18, #1, Jan. 82, pp. 23–28.

R. S. Hawke et al., "Results of Railgun Experiments Powered by Magnetic Flux Compression Generators", IEEE Trans on Magnetics, V. 18, #1, Jan. 82, pp. 82–93.

E. K. Inall, "High Power High Energy Pulse Production and Application", Australian–US Seminar on Energy . . . Switching, Canberra and Sydney, 1977.

*Primary Examiner*—David H. Brown
*Assistant Examiner*—John E. Griffiths
*Attorney, Agent, or Firm*—R. P. Lenart

[57] ABSTRACT

An armature for use in electromagnetic projectile launchers is provided with a plurality of modular conductive fiber bundles which are arranged in a rectangular array and attached to an insulating armature support structure. The conductive fibers extend across the launcher bore and are sized to provide an interference fit between a pair of generally parallel conductive launcher rails. Each fiber bundle includes a rectangular central sheath and a pair of peripheral rectangular sheets positioned on opposite sides of the central sheath. The axis of each peripheral sheet is positioned at an angle with respect to the axis of the central sheath.

5 Claims, 5 Drawing Figures

MODULAR FIBER ARMATURE FOR ELECTROMAGNETIC LAUNCHERS

STATEMENT OF GOVERNMENT INTEREST

The United States Government has rights in this invention pursuant to Contract No. DAAK10-79-C-0110, between Westinghouse Electric Corporation and the Department of Defense.

BACKGROUND OF THE INVENTION

This invention relates to armatures for conducting very large current between parallel rails of an electromagnetic launcher and, more particularly, to such armatures which employ multiple conducting fibers to conduct current between the launcher rails.

In the electromagnetic propulsion of projectiles, a very large DC current which may be on the order of 1 million amperes, is injected into the breech end of a pair of conductive parallel rails. A sliding conductive armature serves to conduct current between the rails and is accelerated by the interaction of a magnetic field generated by current flowing in the rails and the current passing through the armature. The armature is mechanically linked to a payload, thus providing the payload acceleration necessary for a launch.

Although metal fiber armatures have been successfully used to accelerate projectiles, some arcing and rail damage has resulted from poor mechanical behavior of the fibers. U.S. Pat. No. 4,457,205, issued July 3, 1984 to Ross discloses multifiber armatures for electromagnetic launchers and is hereby incorporated by reference.

One embodiment of the Ross armature includes fibers which are swept back from a central band that lies perpendicular to the launcher rail surfaces. Such a design may not provide sufficient control over the ends of the fibers. A second embodiment of the Ross armature includes short fibers attached to a chevron structure. That embodiment has limited practicality because of the difficulty of joining the metal fibers to the solid metal chevron.

SUMMARY OF THE INVENTION

An armature assembly for conducting very large DC currents between two parallel electrically conductive rails while being driven along a gap between the rails under the influence of electromagnetic forces generated by the flow of current in the rails and the armature, which is constructed in accordance with the present invention comprises: an insulating armature support member sized to form a clearance fit between the launcher rails; a plurality of conductive fibers, each having a length greater than the width of this support member, wherein the conductive fibers are divided into a plurality of fiber bundles with each fiber bundle including a first rectangular sheath encompassing the central portion of the fibers and second and third rectangular sheaths respectively encompassing portions of the fiber bundle positioned on opposite sides of the first sheath. These second and third sheaths are positioned at a preselected angle with respect to the axis of the first sheath and all of the fiber bundles are attached to this support member to form a rectangular fiber array.

The fibers in such an armature exhibit a uniform geometry and reliable mechanical and electrical performance. This uniformity is preserved despite the overall size of the armature, due to the stackability of the modular fiber bundles. The length and orientation of the fibers can be easily controlled and can, therefore, be optimized according to the particular application. By using a modular design, different fiber materials such as tempered copper, molybdenum or tungsten may be used at different locations within the armature to form a graded contact. Since the armature has a rectangular cross-section, more complete utilization of the available rail contact area is provided. During the acceleration of the armature, the path of minimum resistance and inductance occurs along the rear face of the rectangular fiber bundle, therefore current concentrations are minimized.

DESCRIPTION OF THE PREFERRED EMBODIMENT

Figure 1:
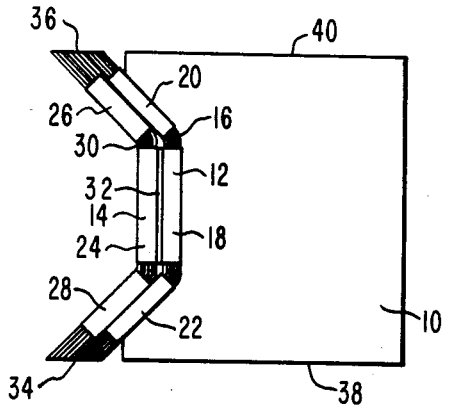
FIG. 1 is a schematic representation of an armature assembly constructed in accordance with one embodiment of the present invention.

Referring to the drawings, FIG. 1 is a schematic representation of an armature assembly constructed in accordance with one embodiment of the present invention. This armature assembly includes an insulating armature support member, or sabot, 10 which is sized to form a clearance fit between a pair of parallel electrically conductive rails of an electromagnetic projectile launcher. A pair of fiber bundles 12 and 14 are shown to be attached to the rear of sabot 10. Fiber bundle 12 is seen to include a plurality of conductive fibers 16, each having a length greater than the width of the sabot structure. A rectangular sheath 18 encompasses the central portion of the fiber 16 and rectangular sheaths 20 and 22 encompass portions of the fibers on opposite sides of sheath 18. Fiber bundle 14 includes a similar structure with a central sheath 24 and two peripheral sheaths 26 and 28, each encompassing a fiber bundle 30. A spacer sheet 32 is positioned between the central sheaths of fiber bundles 12 and 14. The conductive fibers extend to a pair of polished contact surfaces 34 and 36 which lie slightly beyond the sides 38 and 40 of the sabot 10 such that an interference fit is formed between the fiber contact surfaces and the inner surfaces of a pair of conductive projectile launcher rails.

Figure 2:
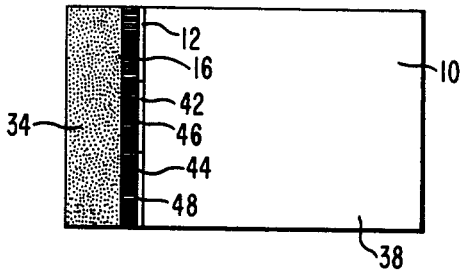
FIG. 2 is a side view of the armature assembly of FIG. 1.

FIG. 2 is a side view of the armature assembly of FIG. 1. In this view, additional modular fiber bundles 42 and 44 which respectively include fiber groupings 46 and 48, are shown to be positioned in a linear array with fiber bundle 12. Additional fiber bundles, not shown, would also be positioned in a linear array with respect to fiber bundle 14. All of the fibers in these various modular bundles extend to the contact surface 34.

Figure 3:
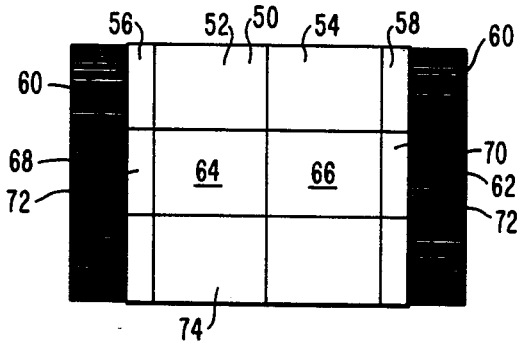
FIG. 3 is an end view of a linear array of fiber bundles used in the armature assembly of FIG. 1.

FIG. 3 is an end view of a linear array of fiber bundles that employ an alternative modular fiber bundle design which includes two central rectangular sheaths in each fiber module. In particular, fiber module 50 includes two central rectangular sheaths 52 and 54 and two peripheral rectangular sheaths 56 and 58 all encompassing a group of fibers 60. Similarly, fiber module 62 includes two central rectangular sheets 64 and 66 and two peripheral rectangular sheets 68 and 70, all encompassing a group of fibers 72. A third fiber bundle 74 is constructed in a similar manner. While the use of two central sheaths may facilitate bundle fabrication, it should be noted that only one central sheath is required in this invention.

Figure 4:
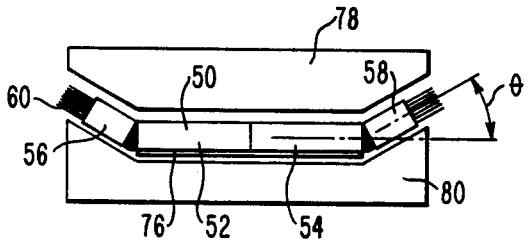
FIG. 4 is a schematic representation of a fixture used to form bends in one of the modular fiber bundles in the armature assembly of FIG. 1.

FIG. 4 is a schematic representation of a fixture which may be used to provide an appropriate angle $\theta$ between the axis of the central rectangular sheath and each peripheral rectangular sheath in each modular fiber bundle. In this embodiment, fiber bundle 50 is shown to be attached to a spacer sheet 76 and the resulting assembly is placed between a fixture comprising a top member 78 and a bottom member 80. This fixture provides compression used in bonding the modular assembly 50 to the spacer plate 76 and also produces an appropriate angle $\theta$ of about 35° between the axis of the central rectangular sheaths and each peripheral rectangular sheaths.

Figure 5:
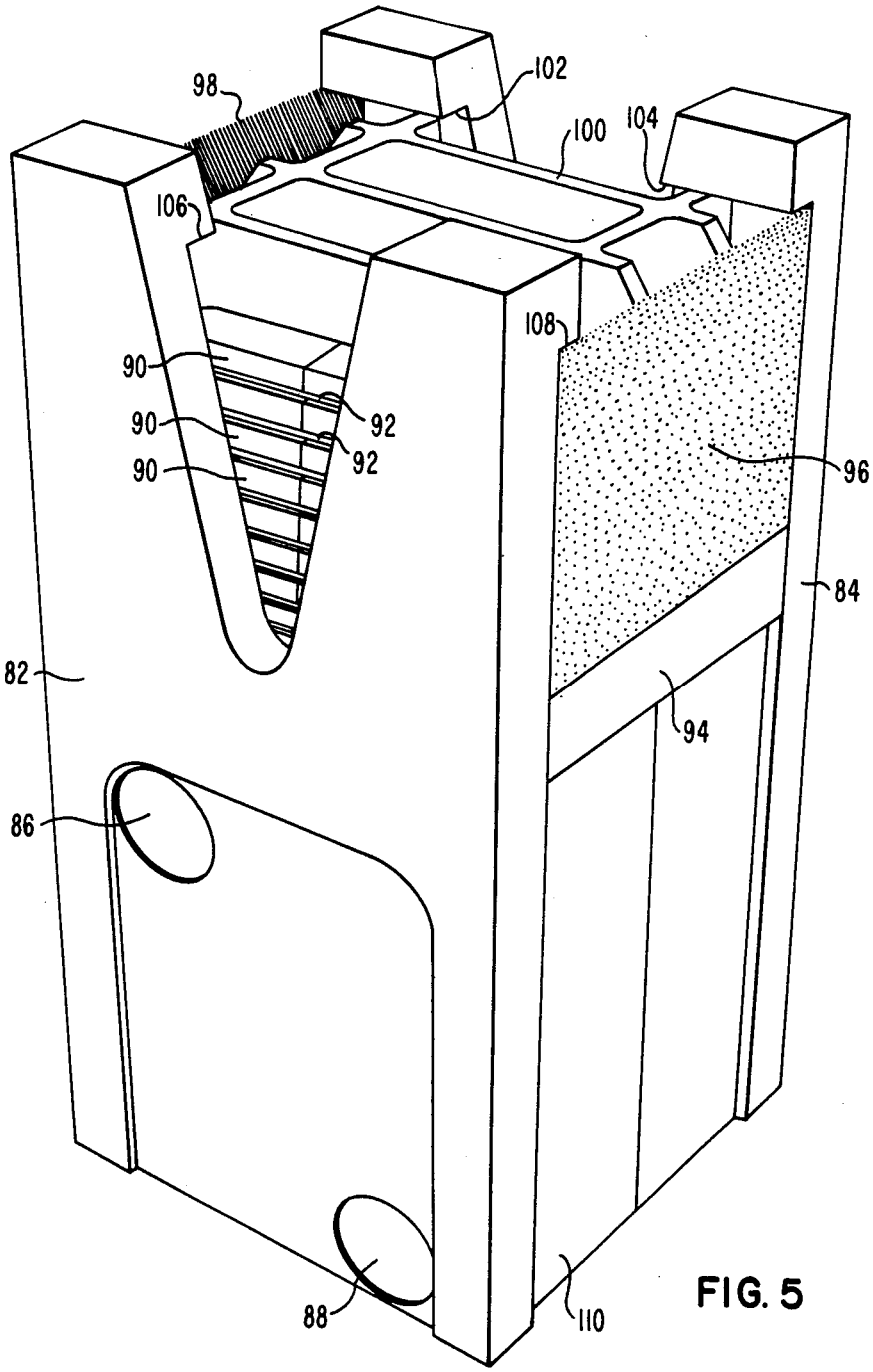
FIG. 5 is an isometric view of an armature assembly constructed in accordance with this invention.

FIG. 5 is an isometric view of an armature assembly constructed in accordance with one embodiment of the invention. In this embodiment, the sabot structure is seen to include two halves 82 and 84. These sabot halves are held together by diagonally opposed screws located in openings 86 and 88. A plurality of modular fiber bundles 90 are positioned in linear arrays similar to FIG. 3, having three modules per array. These arrays are separated by spacer sheets 92. The stacking of these arrays results in a rectangular brush structure which is mounted within the sabot behind a brush spacer 94 which is shaped similar to the bottom element 80 of the fixture in FIG. 4. All conductive fibers of the modular fiber bundles extend between contact faces 96 and 98. A brush compression grid 100 is positioned at the rear of the modular array and is held in place by projections 102, 104, 106 and 108 which extend from the sabot halves.

The starting material for the construction of the armature assembly of FIG. 5 includes a plurality of non-insulated 0.006 inch copper fibers which make up a single cable of 1,050 strands, subdivided into 7 individual bundles of 150 strands each. A single brush element includes a 3½ inch length of cable, with spiral bundles unwound to relatively parallel alignment. Two stainless steel cylinders are positioned at the center of the cable. The cylinders are machined to a 0.008 inch wall thickness and annealed in a vacuum furnace under a pressure of $5\times10^{-5}$ torr at a temperature of 1025° Celsius for 30 minutes. Using a rectangular die, the cylindrical tubes having a length of ⅝ inch are compressed under a hydraulic pressure of 12 tons/sq.in. to form a rectangular cross-section of 0.502×0.100 inch. The result is a closely packed body of copper fibers with a theoretical density of 92%. This forms the central sheath around the modular fiber element. A stripper plate positioned within the die is used to remove the tightly formed brush module from the die. After removal, two annealed ¼ inch long stainless steel cylinders are positioned around the fibers of the bundle on opposite ends of the central rectangular sheaths and deformed into an elliptical shape. These cylinders are positioned to touch the edges of the center sheath and are inserted in the same rectangular die. A load of 5 tons/sq.in. is applied and the rectangular sheath formation process is repeated. At this point, the center sheaths are firmly fixed in position because of the high pressure, while the end sheaths are slightly movable. The fibers between the central sheaths and the end sheaths can then be bent to form the appropriate angle between the axis of the center sheaths and the axis of each peripheral sheath. During the deflection, the peripheral sheaths will slide over the fibers but remain in position.

A linear array of three modules is then constructed by epoxy-bonding individual modules onto spacer plate. The final brush assembly then includes eight layers of three-brush modules each which are stacked to form a generally rectangular fiber brush. At this point, the brush assembly is complete except that the length of the individual fibers is oversized. Polishing of the fiber ends is then accomplished with the brush fibers in place. To establish a flat or bearing contact surface, various thicknesses of steel plates are taped into the recess 110 on the side of the sabot structure and a horizontal metallurgy polishing machine is used to polish the fiber ends. As the dimensions reach the final stages, the plates in the sabot recess are changed to achieve the desired overall brush length. Finally, the last plate is removed and the brush contact faces are now sized to form an interference fit between the internal surfaces of a pair of parallel projectile launching rails.

The present invention armature assembly can be seen to include modular fiber building blocks which contain conductive fibers that span the entire bore width of an electromagnetic launcher, from the interior surface of one rail to the interior surface of another rail. The fibers are enclosed in rectangular sheaths that are pressed around the fibers to give a high packing density and support against electromagnetic loads during acceleration. The use of discrete, stackable bundles facilitates the use of different fiber materials in the armature. For example, high melting point materials, such as molybdenum, may be used in the area of the armature that sees the most current. This would tend to reduce the maximum temperature rise within the armature, delay the onset of armature melting, and reduce rail damage.

Fiber geometry near the rails is controlled by the use of the outer rectangular sheaths which have been angled in a forming die to accurately control the angle of entry of the fibers to the adjacent rail surface. The friction force at the fiber-rail interface is an important factor in overall armature performance. Too much friction will lead to heat dissipation and rail damage, while too little friction will increase electrical contact resistance, which can lead to arcing and rail damage. Among the keys to controlling the friction force are the control of the length of the angled fibers and the control of the angle of the angled fibers. The modular design provides adequate control of these factors.

The armatures of the present invention do not require the use of joining alloys such as solders or brazing materials. Individual fiber bundles can be easily replaced, repaired or repolished, and reassembled. The size of the armature can be easily scaled up or down and graded contacts can be constructed.

The armature of FIG. 5 was tested at a current density of 1.3 GA/m$^2$ and a velocity of 1800 meter/second. Rail damage was sufficiently small so that the rails were used for more than one shot. The total shot current was 1.3 mega-amperes.

While the present invention has been described in terms of what is at present believed to be its preferred embodiment, it will be apparent to those skilled in the art that various changes may be made without departing from the scope of the invention. For example, although the same sheath material should be used for each fiber bundle in a given assembly, various high strength, formable materials such as brass, aluminum, steel and copper may also be used. The sheath wall thickness may be varied to control the clearance between brush bundles and thereby control the flexing of the brush fibers. It is, therefore, intended that the appended claimscover all such changes.

What is claimed is:

1. An armature assembly for conducting very large DC current between two parallel, electrically conductive rails while being driven along a gap between the rails under the influence of electromanetic forces generated by the flow of said very large DC current, said armature assembly comprising:

an insulating armature support member capable of being sized to form a clearance fit between said rails;

a plurality of conductive fibers, each having a length greater than the width of said support member;

said conductive fibers being divided into a plurality of fiber bundles where each bundle includes a first rectangular sheath having an axis and encompassing a first portion of a first group of said conductive fibers and second and third rectangular sheaths, respectively encompassing second and third portions of said first group of said conductive fibers wherein said second and third sheathes are positioned on opposite sides of said first sheath and are positioned at a preselected angle with respect to the axis of said first sheath; and means for attaching said fiber bundles to said support member.

2. An armature assembly as recited in claim 1, wherein said fiber bundles are arranged in an array having a rectangular cross-section.

3. An armature assembly as recited claim 1, wherein the packing density of said fibers within said first sheath is greater than the packing density of said fibers within said second and third sheaths.

4. An armature assembly as recited in claim 1, further comprising:

a spacer sheet, wherein the first sheath of several of said bundles is bonded to said spacer sheet.

5. An armature assembly as recited in claim 1, wherein the axis of the first sheath of each of said bundles capable of lying perpendicular to the inside surfaces of said rails.

* * * * *